United States Patent [19]

Grundmann et al.

[11] Patent Number: 4,671,054

[45] Date of Patent: Jun. 9, 1987

[54] MECHANISM FOR PURGING FIBER FLUFF AND DUST FROM A SPINDLE ASSEMBLY OF A TWO-FOR-ONE TWISTER TEXTILE THREAD PROCESSING MACHINE

[75] Inventors: Reinhard Grundmann; Carl Kramer, both of Aachen, Fed. Rep. of Germany

[73] Assignee: Palitex Project-Company GmbH, Krefeld, Fed. Rep. of Germany

[21] Appl. No.: 932,166

[22] Filed: Nov. 18, 1986

[30] Foreign Application Priority Data

Dec. 11, 1985 [DE] Fed. Rep. of Germany ..... 3543650

[51] Int. Cl.[4] ..... D01H 11/00; D01H 1/10; D01H 7/86

[52] U.S. Cl. ..... 57/304; 57/58.49; 57/58.83; 57/305; 57/308; 57/354

[58] Field of Search ..... 57/300, 304, 305, 308, 57/58.49, 58.83, 58.86, 354–357

[56] References Cited

U.S. PATENT DOCUMENTS

| | | | |
|---|---|---|---|
| 3,374,618 | 3/1968 | Franzen | 57/304 |
| 3,763,526 | 10/1973 | Benson et al. | 57/304 X |
| 3,857,228 | 12/1974 | Nakahara et al. | 57/304 |
| 3,973,381 | 8/1976 | Teranishi | 57/58.83 |
| 4,055,937 | 11/1977 | Latus et al. | 57/58.49 X |
| 4,107,910 | 8/1978 | Furstenberg et al. | 57/354 X |
| 4,435,952 | 3/1984 | Stahlecker et al. | 57/304 X |
| 4,472,931 | 9/1984 | Stahlecker | 57/304 X |

*Primary Examiner*—John Petrakes

*Attorney, Agent, or Firm*—Bell, Seltzer, Park & Gibson

[57] ABSTRACT

A mechanism for pneumatically purging undesirable fiber fluff and dust from a spindle assembly of a two-for-one twister textile thread processing machine created during thread processing and particularly in the area of a rotating thread balloon and being characterized by utilizing air flow created by operation of the spindle assembly in processing thread without disturbing the rotating thread balloon is provided. The purging mechanism includes a housing jacket axially mounted on one end of a balloon limitor device and having a generally curved inner wall spaced from the axis of the spindle assembly rotor mechanism and the carrier mechanism a greater distance than the inner wall of the balloon limitor and a lateral opening on one side thereof, and a duct connected to the lateral opening and adapted to lead to a collecting container. With this arrangement, the purging mechanism acts in flow-technology respects with the balloon limitor and centrifugal forces and air flow created by the rotating thread balloon and spindle mechanisms as a surge diffuser for purging undesirable fiber fluff and dust.

11 Claims, 6 Drawing Figures

MECHANISM FOR PURGING FIBER FLUFF AND DUST FROM A SPINDLE ASSEMBLY OF A TWO-FOR-ONE TWISTER TEXTILE THREAD PROCESSING MACHINE

FIELD OF THE INVENTION

This invention relates to a mechanism for pneumatically purging undesirable fiber fluff and dust from a spindle assembly of a two-for-one twister textile thread processing machine which is created during thread processing and particularly in the area of a rotating thread balloon.

BACKGROUND OF THE INVENTION

During thread processing at each spindle assembly of a two-for-one twister textile thread processing machine, severe fiber fluff and dust are created, as a rule, which leads to fouling of the operating mechanisms in the spindle assembly and of the thread being processed resulting in undesired maintenance time by operating personnel, reduced quality of processed thread and an undesirable environment for operating personnel.

Various proposals have been made to inhibit the development of fiber fluff and dust in the room of the manufacturing operation containing the thread processing machines and to protect the sensitive machine parts in the spindle assembly and the thread itself by blowing-off periodically or continuously such fiber fluff and dust. Since the fiber fluff and dust, in the case of two-for-one twister thread processing machine spindle assemblies occurs to an increased extent in the region of the rotating thread balloon, proposals have already been made for carrying off the fiber fluff and dust, without disturbing the thread balloon, out of the balloon limitor interior, i.e. the annular gap between the balloon limitor and the bobbin carrier.

Such a proposal has been made in German Gebrauchsmusterschrift No. 1 862 735 which discloses a substantially frusto-conical hood superimposed onto the upper edge of the balloon limitor and which has a lateral opening in the region of the cone surface to which a duct is connected and leads to a collecting container. The object of the mechanism of this German patent is to use the existing air flow, which is generated by the rotating thread balloon as well as the rotating parts of the spindle assembly to carry the fiber fluff and dust in a special collecting channel or respectively collecting container connected to the hood. Because the discharge opening in the hood is arranged in the region of the upwardly narrowing cone surface, the intensity of the fiber fluff and dust blow-off flow is relatively slight. Accordingly, it has been found with the use of this mechanism that an under pressure air flow is required to be generated to increase the intensity of the air flow in the channel leading to the collecting container.

OBJECT AND SUMMARY OF THE INVENTION

Accordingly, it is the object of this invention to provide a mechanism for pneumatically purging fiber fluff and dust from a spindle assembly of a two-for-twister textile thread processing machine which are created during thread processing and particularly in the area of the rotating thread balloon and which is characterized by utilizing only air flow created by operation of the spindle assembly in processing thread without disturbing the rotating thread balloon.

By this invention, it has been found that such a purging mechanism can be provided, in a two-for-one twister textile thread processing machine having a spindle assembly for processing of thread including a driven rotor mechanism, a stationary carrier mechanism axially mounted on the rotor mechanism for carrying a hollow supply package of thread, a thread passageway formed through the carrier mechanism and the rotor mechanism to receive the thread from the supply package and provide a path for the moving thread during processing axially downwardly through the carrier mechanism and the rotor mechanism and radially outwardly of the rotor mechanism to form an upwardly moving rotating balloon of thread around the rotor mechanism and the carrier mechanism, and a generally cylindrical balloon limitor device surrounding the rotating balloon of thread, which comprises generally the following.

The purging mechanism includes a housing jacket axially mounted on one end of the balloon limitor device and having a generally curved inner wall spaced from the axis of the rotor mechanism and the carrier mechanism a greater distance than the inner wall of the balloon limitor and a lateral opening on one side thereof, and a duct connected to the lateral opening and adapted to lead to a collecting container. With this arrangement, the fiber fluff and dust transported upwardly with the air flow between the balloon limitor and the carrier mechanism can be blown out laterally of the spindle assembly with a housing jacket which acts in flow-technology respects with the balloon limitor and the centrifugal forces and air flow created by the rotating balloon as a surge diffuser for purging undesirable fiber fluff and dust since the centrifugal forces widen in the housing jacket in a separation-free manner as the housing jacket widens in a diffuser-like manner.

With the purging mechanism in accordance with this invention, the lateral opening lies at a relatively greater distance to prevent disturbing the rotating thread balloon as occurs in the mechanism in accordance with the above described German patent in which the lateral opening receiving a duct to the collecting container is disposed in a conically narrowing hood or jacket part in the immediate vicinity of the rotating balloon path.

It is preferable that the purging mechanism in accordance with this invention include an inner wall of the housing jacket which comprises a configuration whereby the distance between the inner wall and an imaginary extension of the balloon limitor and the axis thereof increases in a diffuser-like manner from a location diametrically opposite to the lateral opening in the housing jacket on at least one side of the inner wall toward the lateral opening. It is also preferable that the housing jacket comprise a cylindrical housing jacket mounted on the balloon limitor so that the axis of the cylindrical housing jacket is eccentric to the axis of the balloon limitor device in the direction of the lateral opening.

BRIEF DESCRIPTION OF THE DRAWINGS

While some of the objects and advantages of this invention have been set forth above, other objects and advantages will appear as the description proceeds in conjunction with the attached drawings, in which.

DETAILED DESCRIPTION OF PREFERRED EMBODIMENTS

Figure 1:
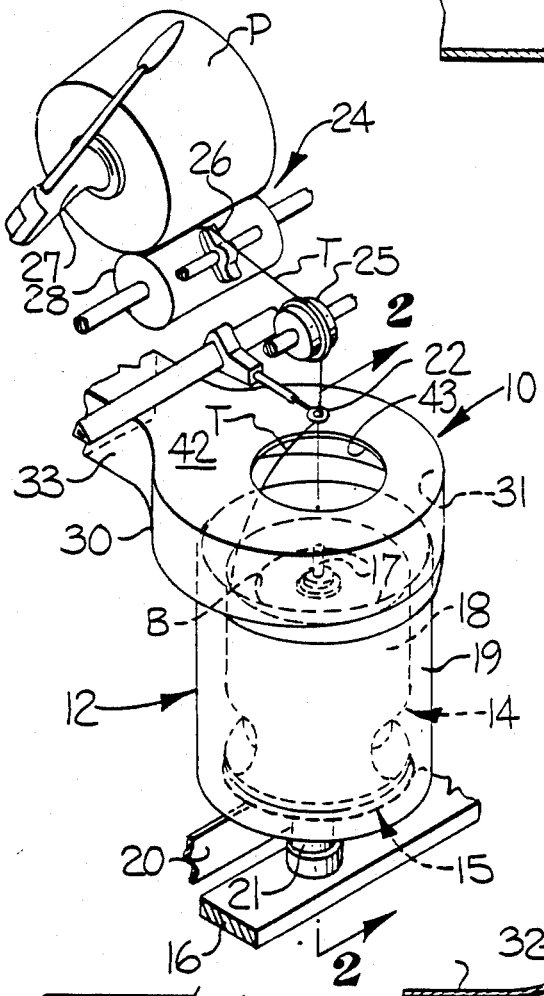
FIG. 1 is a schematic perspective view, partially broken away, illustrating one spindle assembly station of a two-for-one twister textile thread processing machine utilizing a first embodiment of a purging mechanism in accordance with this invention.
Figure 2:
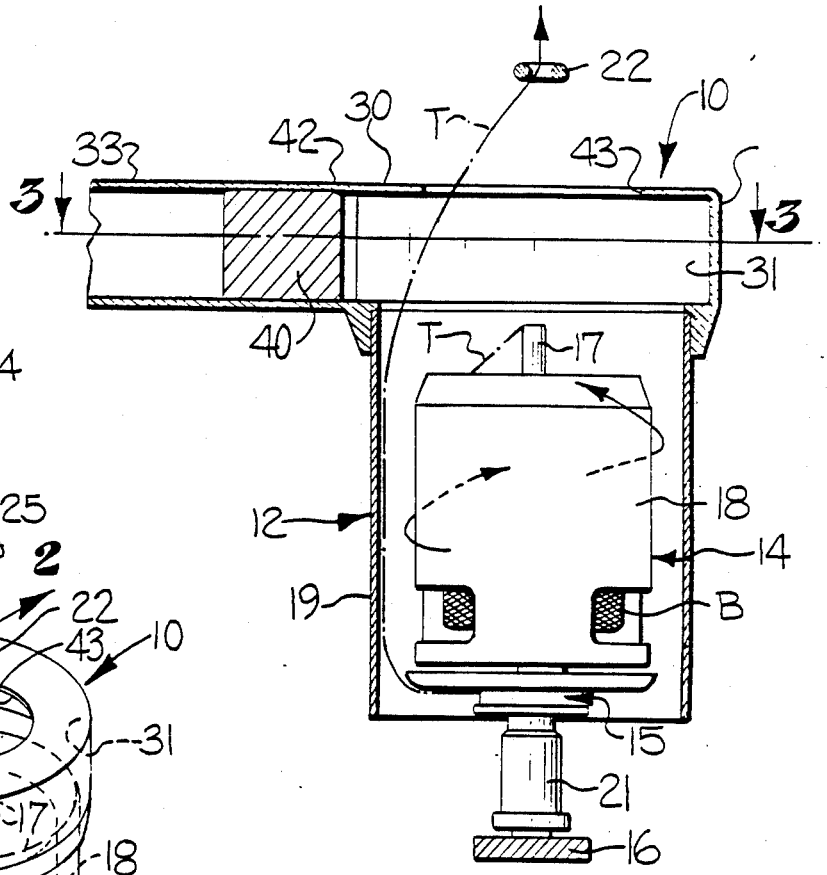
FIG. 2 is a sectional view, taken generally along the line 2—2 FIG. 1.
Figure 3:
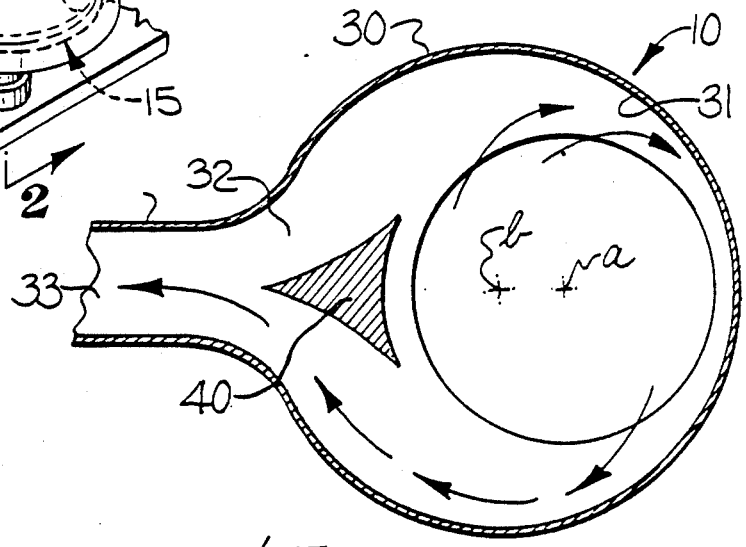
FIG. 3 is sectional view, taken generally along the line 3—3 of FIG. 2; broken away, illustrating one spindle assembly station of a two-for-one twister textile thread processing machine utilizing a second embodiment of purging mechanism in accordance with this invention.

Referring now to the drawings, FIGS. 1-3 illustrate the use of a first embodiment of purging mechanism 10 utilized in a spindle assembly station of a two-for-one twister textile thread processing machine. It is to be understood that a two-for-one twister textile thread processing machine utilizes a number of such spindle assembly stations in side-by-side arrangement on each side of the machine. The spindle assembly station of a two-for-one twister textile thread processing machine includes a spindle assembly, generally indicated at 12, having a stationary carrier mechanism 14 for receiving a hollow supply package B of thread T. The spindle assembly 12 further includes a rotor mechanism 15 which is mounted to the machine frame 16 and constructed for rotation relative to and axially carrying the stationary carrier mechanism 14. The carrier mechanism 14 includes a hollow thread entry tube 17 extending axially through the thread package B to form a thread passageway for the thread T therethrough. Such thread passageway communicates with a thread passageway (not shown) in the rotor mechanism 15 for providing a combined thread passageway to receive the thread from the supply package B and provide a path for the moving thread T during processing axially downwardly through the carrier mechanism 14 and the rotor mechanism 15 and radially out of the rotor mechanism 15. The carrier mechanism 14 includes a basket device 18 surrounding the thread supply package B and a balloon limitor device 19 surrounding the basket device 18 and spaced therefrom. The rotor mechanism 15 is rotatably driven by a drive belt 20 in engagement with a whorl 21 in a known manner.

When the thread T is threaded through the spindle assembly 12 in the manner illustrated and the rotor mechanism 15 is rotated, the thread T is drawn from the supply package B and passes downwardly into the yarn entry tube 17 and through the yarn passageway to emerge from the rotor mechanism 15 to form a rotating balloon of thread T between the basket device 18 and the balloon limitor device 19. The thread T is then directed through a thread guide eyelet 22 above the spindle assembly 12 and then to a take-up mechanism 24 including a pre-take-up roll 25, a traversing mechanism 26 and a take-up package forming device 27 to form a take-up package P of processed thread which is rotated by drive roll 28.

This operation of a two-for-one twister textile thread processing machine is well understood by those with ordinary skill in the art and further explanation and illustration thereof is not deemed necessary herein for an understanding of the present invention.

As discussed above, undesirable fiber fluff and dust are created in the spindle assembly 12 and particularly in the area of the rotating thread balloon between the balloon limitor device 19 and the basket device 18 of the carrier mechanism 14. In order to purge this undesirable fiber fluff and dust, a pneumatic purging mechanism 10 is provided in accordance with this invention. Such mechanism 10 for pneumatically purging the fiber fluff and dust from the spindle assembly 12 comprises a housing jacket 30 axially mounted on one end of the balloon limitor device 19 and having a generally curved inner wall 31 spaced from the axis of the rotor mechanism 14 and the carrier mechanism 15 a greater distance than the inner wall of the balloon limitor device 19 (FIG. 2 and 3). The housing jacket 30 further defines a latteral opening 32 on one side thereof to which is mounted or integrally formed a duct 33 which leads to a collecting container (not shown).

With this arrangement, the purging mechanism 10 acts in flow-technology respects with the balloon limitor device 19 and the centrifugal forces and air flow created by the rotating spindle assembly parts and thread balloon as a surge diffuser for purging undesirable fiber fluff and dust. In operation, i.e. when the spindle rotor mechanism 15 is rotating and as a result of the rotating thread balloon, there occurs in the annular gap between the balloon limitor device 19 and the basket device 18 of the carrier mechanism 14 an upwardly-directed severely-twisted air flow. The bits of fiber fluff and dust transported upwardly with this air flow are, with the housing jacket 30, acting in flow-technology respects as a surge diffuser for blowing the fiber fluff and dust laterally out of the region of the spindle assembly 12. Because the inner wall 31 of the housing jacket 30 of the purging mechanism 10 has a larger spacing from the axis of the spindle rotor mechanism 15 and carrier mechanism 14 than does the inner wall of the balloon limitor device 19, the air flow widens due to the centrifugal forces in a separation-free manner in the widened channel of the housing jacket 30 of the purging mechanism 10.

Preferably, the inner wall 31 of the housing jacket 30 of the purging mechanism 10 comprises a configuration whereby the distance between the inner wall 31 and an imaginary extension of the balloon limitor device 19 and the axis thereof increases in a diffuser-like manner from a location diametrically opposite to the lateral opening 32 in the housing jacket 30 on at least one side of the inner wall 31 toward the lateral opening 32. It is also preferable that the housing jacket 30 of the purging mechanism 10 comprise a cylindrical housing jacket mounted on the balloon limitor so that the axis b of the cylindrical housing jacket 30 is eccentric to the axis a of the balloon limitor device 19 in the direction of the lateral opening 32 (FIG. 3).

The purging mechanism 10 may further include a gore-shaped guide body 40 symmetrically positioned with the housing jacket at the lateral opening 32 with the gore-end portion thereof directed toward the lateral opening 32 and having a side facing the rotating thread balloon in the shape of a partial arc of a circle (FIG. 3). This gore-shaped body has the function of guiding the air flow, acting with the fiber fluff and dust, directly to the lateral opening 32 and the duct 33 leading to the collecting container. This simple-symmetrical arrangement of housing jacket 30 and guide body 40 makes possible a function which is independent of the direction of rotation of the rotor mechanism 15 and the thread balloon and this rotation can be in a clockwise or counterclockwise direction.

If the basket device 18 is provided with windows, as shown in FIGS. 1 and 2, the fiber fluff and dust transported out of the windows are likewise grasped by the air flow and transported off outwardly without entering the annular space between the balloon limitor device 19 and the basket device 18.

As illustrated in FIGS. 1-3, the housing jacket 30 of the purging mechanism 10 is axially mounted on the upper end of the balloon limitor device 19. With this arrangement, the housing jacket 30 of the purging mechanism 10 further includes an upper covering wall 42 over the top thereof which defines an opening 43 therethrough for the moving thread T.

The volume of air flow which is, in the case of the embodiment in accordance with FIGS. 1-3, conducted upwardly in the annular gap between the balloon limitor device 19 and the basket device 18 of the carrier mechanism 14 can be influenced by a choice of the position of the lower edge of the balloon limitor device relative to the spindle rotor mechanism 15. If the purging mechanism 10 is positioned on top of the balloon limitor device 19, it is preferred for the balloon limitor device 19 to extend below the portion of the rotor mechanism 15 from which the moving thread T emerges radially, as shown in FIG. 2.

Figure 4:
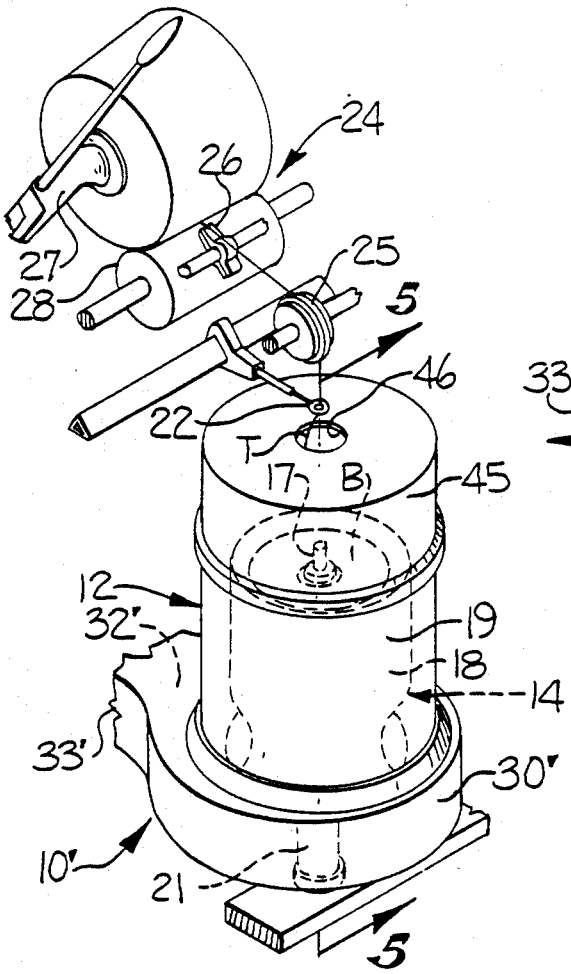
Figure 5:
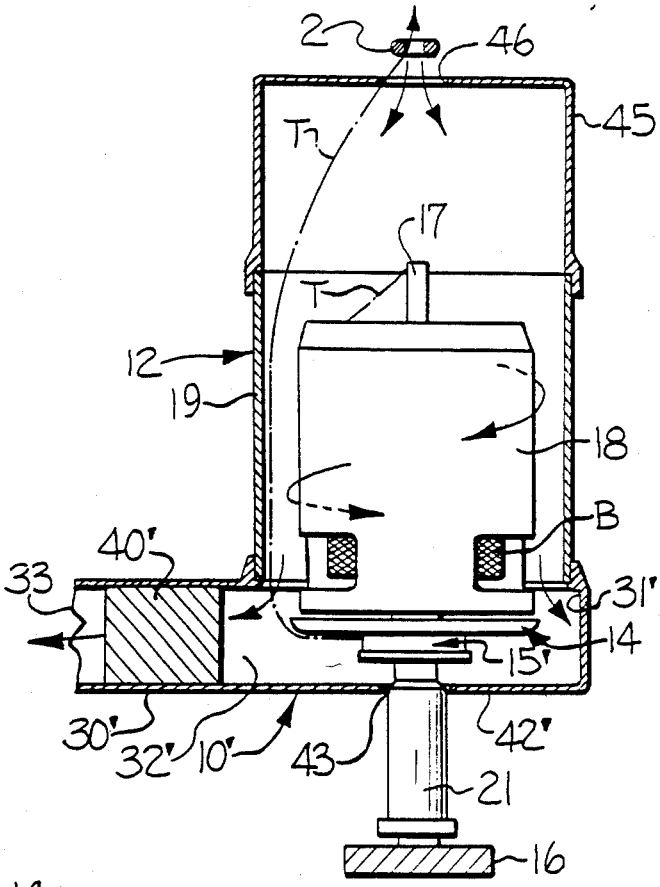
FIG. 5 is a sectional view, taken generally along the line 5—5 of FIG. 4.

Referring now to a second embodiment of purging mechanism 10', as illustrated in FIGS. 4 and 5, the components of the spindle assembly station are the same as the embodiment of FIGS. 1-3 and have been given the same reference characters and will not be further described. Likewise, the structure of the purging mechanism 10' is very similar to that of the purging mechanism 10 of the embodiment of FIGS. 1-3 and will be given similar reference characters with prime notations where the structure is generally the same.

The purging mechanism 10' of the embodiment of FIGS. 4-5 differs from that of the embodiment of Figures 1-3 by being axially mounted on the lower end of the balloon limitor device 19. With this arrangement, it is preferable that the lower edge of the balloon limitor device be positioned above the rotor mechanism 15 and the passageway therethrough where the moving thread T radially exits the rotor mechanism 15. The purging mechanism 10' of this embodiment further includes a hood member 45 axially mounted on the upper end of the balloon limitor device 19 and defining a central opening 46 therethrough for the moving thread T. With this arrangement of a shortened balloon limitor device 19 and a covering hood member 45, a reversal of air flow direction in the annular gap between the balloon limitor device 19 and the basket device 18 of the carrier mechanism 14 occurs to provide an air flow from the top downwards.

Preferable, the housing jacket 30' includes a bottom covering wall 42' which defines an opening 43 therethrough for projection of the lower portion of the rotor mechanism 15.

This embodiment of FIGS. 4-5 with air flow from the top downwards in the spindle assembly 12 is particularly suitable for use in an environment utilizing air conditioning. The air conditioned air needs only to be introduced centrally into the opening 46 of the hood 45 for circulation through the spindle assembly. Of course, air conditioned air can also be utilized with the embodiment of FIGS. 1-3 by introducing the air conditioned air into the bottom of the balloon limitor device 19 to flow from the bottom to the top of the spindle assembly 12.

Referring now to the opening 46 in the hood member 45 of the embodiment of FIGS. 4 and 5 of the purging mechanism 10', the air flow can be severely influenced by the size of this opening. With an opening diameter of about 45 mm up to about 55 mm, a flow directed reliably downwards can be generated.

Figure 6:
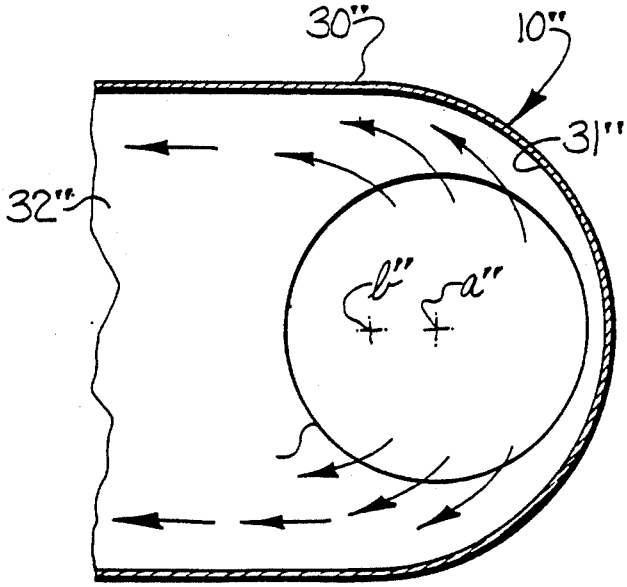
FIG. 6 is a sectional view through a modified form of housing jacket which can be utilized in either of the embodiments of purging mechanism shown in FIGS. 1—3 or 4—5.

As illustrated in both of the embodiments of FIGS. 1-3 and 4-5, the housing jacket 30, 30' of the purging mechanism 10, 10' preferably has a portion thereof in the configuration of a partial arc of a circle of substantially more than 180° terminating at the lateral opening 32, 32'. However, a modification of this shape is possible, as illustrated in the further embodiment of FIG. 6 wherein the housing jacket 30'' of the purging mechanism 10'' has a wall portion thereof in the configuration of a partial arc of a circle of generally 180° and linking wall portions in the configuration of axially-parallel tangents extending from said circular portion and terminating at the lateral opening 32''. With this arrangement, the housing jacket of the purging mechanism still operates as a surge diffuser which takes into account both possible directions of rotation of the spindle assembly 10 and caters very well to the operability of such spindle assembly 10.

In the drawings and specification there have been set forth preferred embodiments of this invention, and although specific terms are employed, they are used in a generic and descriptive sense only and not for purposes of limitation, the scope of the invention being defined in the following claims.

What is claimed is:

1. In a two-for-one twister textile thread processing machine having a spindle assembly for processing of thread including a driven rotor mechanism, a stationary carrier mechanism axially mounted on said rotor mechanism for carrying a hollow supply package of thread, a thread passageway formed through said carrier mechanism and said rotor mechanism to receive the thread from the supply package and provide a path for the moving thread during processing axially downwardly through said carrier mechanism and said rotor mechanism and radially outwardly of said rotor mechanism to form an upwardly moving rotating balloon of thread around said rotor mechanism and said carrier mechanism, and a generally cylindrical balloon limitor device surrounding the rotating balloon of thread; the combination therewith of a mechanism for pneumatically purging from said spindle assembly undesirable fiber fluff and dust created during thread processing and particularly in the area of the rotating thread balloon and being characterized by utilizing air flow created by operation of the spindle assembly in processing thread without disturbing the rotating thread balloon, said purging mechanism comprising a housing jacket axially mounted on one end of said balloon limitor device and having a generally curved inner wall spaced from the axis of said rotor mechanism and said carrier mechanism a greater distance than the inner wall of said balloon limitor and a lateral opening on one side thereof, and a duct connected to said lateral opening and adapted to lead to a collecting container; whereby said purging mechanism acts in flow-technology respects with said ballon limitor and the centrifugal forces and air flow created by the rotating thread balloon and rotor mechanism as a surge diffuser for purging undesirable fiber fluff and dust.

2. In a two-for-one twister textile thread processing machine, as set forth in claim 1, in which said inner wall of said housing jacket of said purging mechanism comprises a configuration whereby the distance between said inner wall and an imaginary extension of said balloon limitor device and the axis thereof increases in a diffuser-like manner from a location diametrically opposite to said lateral opening in said housing jacket on at least one side of said inner wall toward said lateral opening.

3. In a two-for-one twister textile thread processing machine, as set forth in claim 2, in which said housing jacket of said purging mechanism comprises a cylindrical housing jacket mounted on said balloon limitor device so that the axis of said cylindrical housing jacket is eccentric to the axis of said balloon limitor device in the direction of said lateral opening.

4. In a two-for-one twister textile thread processing machine, as set forth in claim 1, in which said purging mechanism further includes a gore-shaped guide body symmetrically positioned within said housing jacket at said lateral opening with the gore-end portion thereof directed toward said lateral opening and having a side facing the rotating thread balloon in the shape of a partial arc of a circle.

5. In a two-for-one twister textile thread processing machine, as set forth in claim 1, in which said housing jacket of said purging mechanism has a portion thereof in the configuration of a partial arc of a circle of substantially more than 180° terminating at said lateral opening.

6. In a two-for-one twister textile thread processing machine, as set forth in claim 1, in which said housing jacket of said purging mechanism has a wall portion thereof in the configuration of a partial arc of a circle of generally 180° and linking wall portions in the configuration of axially-parallel tangents extending from said circular portion and terminating at said lateral opening.

7. In a two-for-one twister textile thread processing machine, as set forth in claim 1, 2, 3, 4, 5 or 6, in which said housing jacket of said purging mechanism is axially mounted on the upper end of said balloon limitor device.

8. In a two-for-one twister textile thread processing machine, as set forth in claim 7, in which said housing jacket of said purging mechanism further includes an upper covering wall over the top thereof which defines an opening therethrough for the moving thread.

9. In a two-for-one twister textile thread processing machine, as set forth in claim 1, 2, 3, 4, 5 or 6, in which the lower edge of said balloon limitor is positioned above said rotor mechanism and said passageway therethrough where the moving thread radially exists said rotor mechanism, and in which said housing jacket of said purging mechanism is axially mounted on the lower end of said balloon limitor device, and includes bottom covering wall over the bottom portion thereof which defines a opening therethrough for projection of the lower portion of said rotor mechanism.

10. In a two-for-one twister textile thread processing machine, as set forth in claim 9, in which said purging mechanism further includes a hood member axially mounted on the upper end of said balloon limitor device and defining a central opening therethrough for the moving thread.

11. In a two-for-one twister textile thread processing machine, as set forth in Claim 10, in which said central opening of said hood member comprises a diameter of 45 mm to 55 mm.

* * * * *

UNITED STATES PATENT AND TRADEMARK OFFICE

CERTIFICATE OF CORRECTION

PATENT NO. : 4,671,054

DATED : June 9, 1987

INVENTOR(S) : Reinhard Grundmann & Carl Kramer

It is certified that error appears in the above-identified patent and that said Letters Patent is hereby corrected as shown below:

Column 3, line 4, after "Figure 4;" insert a paragraph and then -- Figure 4 is a schematic perspective view, partially --.

Signed and Sealed this

Twentieth Day of October, 1987

*Attest:*

DONALD J. QUIGG

*Attesting Officer*

*Commissioner of Patents and Trademarks*